US011918047B2

(12) United States Patent
Lee

(10) Patent No.: US 11,918,047 B2
(45) Date of Patent: Mar. 5, 2024

(54) CARTRIDGE USED TOGETHER WITH AEROSOL GENERATING DEVICE

(71) Applicant: KT&G CORPORATION, Daejeon (KR)

(72) Inventor: Won Kyeong Lee, Guri-si (KR)

(73) Assignee: KT&G CORPORATION, Daejeon (KR)

( * ) Notice: Subject to any disclaimer, the term of this patent is extended or adjusted under 35 U.S.C. 154(b) by 491 days.

(21) Appl. No.: 17/293,313

(22) PCT Filed: Dec. 14, 2020

(86) PCT No.: PCT/KR2020/018238
§ 371 (c)(1),
(2) Date: May 12, 2021

(87) PCT Pub. No.: WO2021/157845
PCT Pub. Date: Aug. 12, 2021

(65) Prior Publication Data

US 2022/0400753 A1 Dec. 22, 2022

(30) Foreign Application Priority Data

Feb. 5, 2020 (KR) ..... 10-2020-0013736

(51) Int. Cl.
*A24F 40/42* (2020.01)
*A24F 40/46* (2020.01)
*A24F 40/50* (2020.01)

(52) U.S. Cl.
CPC ..... *A24F 40/42* (2020.01); *A24F 40/46* (2020.01); *A24F 40/50* (2020.01)

(58) Field of Classification Search
CPC ..... A24F 40/42; A24F 40/46; A24F 40/50; A24F 40/10; A24F 40/40
See application file for complete search history.

(56) References Cited

U.S. PATENT DOCUMENTS 9,532,605 B2 1/2017 Yamada et al.
2015/0208731 A1 7/2015 Malamud et al.
(Continued)

FOREIGN PATENT DOCUMENTS

JP 6609687 B1 11/2019
KR 10-2016-0060661 A 5/2016
(Continued)

OTHER PUBLICATIONS

Extended European Search Report dated Nov. 24, 2021 in European Application No. 20894920.6.
(Continued)

*Primary Examiner* — Jean F Duverne
(74) *Attorney, Agent, or Firm* — Sughrue Mion, PLLC

(57) ABSTRACT

According to one or more embodiments, a cartridge includes a connector comprising a plurality of terminals configured to provide an electrical connection between the cartridge and an external device; a heater configured to be heated by a current flowing through a first pair of terminals among the plurality of terminals; and a processor configured to: count a number of times a signal is received through a second pair of terminals among the plurality of terminals, store the number of times corresponding to a counting result in a memory, and initialize the stored number of times when the plurality of terminals are short-circuited according to a preset pattern.

8 Claims, 7 Drawing Sheets

(56) References Cited

U.S. PATENT DOCUMENTS

| | | | | |
|---|---|---|---|---|
| 2016/0106936 | A1 | 4/2016 | Kimmel | |
| 2018/0296779 | A1 | 10/2018 | Takeuchi et al. | |
| 2019/0158938 | A1 | 5/2019 | Bowen et al. | |
| 2020/0212517 | A1 | 7/2020 | Akao et al. | |
| 2021/0016028 | A1* | 1/2021 | Cho | A24F 40/53 |
| 2021/0153562 | A1* | 5/2021 | Fishwick | A24F 40/42 |
| 2022/0105284 | A1* | 4/2022 | Lahoud | A24B 15/167 |

FOREIGN PATENT DOCUMENTS

| | | | | |
|---|---|---|---|---|
| KR | 10-2018-0083916 | A | 7/2018 | |
| WO | 2017/205692 | A1 | 11/2017 | |
| WO | 2019081568 | A1 | 5/2019 | |
| WO | 2019/186150 | A1 | 10/2019 | |
| WO | 11497864 | B2 * | 11/2022 | A24F 40/44 |

OTHER PUBLICATIONS

International Search Report dated Jun. 2, 2021 by the International Searching Authority in application No. PCT/KR2020/018238.

* cited by examiner

CARTRIDGE USED TOGETHER WITH AEROSOL GENERATING DEVICE

CROSS REFERENCE TO RELATED APPLICATIONS

This application is a National Stage of International Application No. PCT/KR2020/018238 filed Dec. 14, 2020, claiming priority based on Korean Patent Application No. 10-2020-0013736 filed Feb. 5, 2020.

TECHNICAL FIELD

The present disclosure relates to a cartridge used together with an aerosol generating device.

BACKGROUND ART

Recently, the demand for alternative methods to overcome the disadvantages of traditional cigarettes has increased. For example, there is growing demand for an aerosol generating device which generates an aerosol by heating an aerosol generating material, rather than by combusting cigarettes. A cartridge, which includes a liquid storage accommodating an aerosol generating material therein and an atomizer, is detachably attached to an aerosol generating device, and the aerosol generating material accommodated in the cartridge is heated by power supplied from the aerosol generating device to the cartridge.

When the aerosol generating material accommodated in the liquid storage of the cartridge is completely consumed, the cartridge is supposed to be replaced. However, some users arbitrarily disassemble the exhausted cartridge and refill it with an inauthentic liquid composition, which may be problematic in terms of hygiene. Also, the cartridge and the aerosol may not work properly.

DISCLOSURE

Technical Problem

Reuse of the cartridge by an unauthorized user may be prevented by recording the number of puffs in a memory embedded in a chip or processor installed in the cartridge and locking the cartridge based on the number of puffs.

Although the reuse of the cartridge by the unauthorized user has to be prevented, there is a need to allow proper recycling of the cartridge by an authorized provider considering environmental or political aspects. In order for an authorized provider to collect a cartridge, inject a liquid composition to the collected cartridge, and sell the cartridge again, a process of unlocking the cartridge is required. In this case, if there is a method of simply unlocking a cartridge instead of a complicated way of, for example, replacing a chip or a processor in the cartridge, productivity may be improved.

Technical Solution

One or more embodiments are to satisfy the aforementioned requirements and provide a cartridge used together with an aerosol generating device. The technical problems of the present disclosure are not limited to the aforementioned description, and other technical problems may be derived from the embodiments described hereinafter.

Advantageous Effects

The present disclosure provides a cartridge used together with an aerosol generating device. In detail, the cartridge may include a connector including terminals for forming an electrical connection between the cartridge and an external device, and a processor for counting the number of times a signal is received through some of the terminals and storing information about the number of times corresponding to a counting result. When the stored number is greater than a threshold value, the processor may lock the cartridge by blocking a current flowing to a heater, and thus, the reuse of the cartridge by an unauthorized user may be prevented.

When the terminals of the connector are short-circuited according to a preset pattern, the processor may initialize the stored number. Because the cartridge may be unlocked by using a simple method of short-circuiting the terminals of the connector according to the preset pattern, productivity may be improved in a process of recycling the cartridge by the authorized provider. Also, a pattern for short-circuiting the terminals to unlock the cartridge is determined by a provider in an initial process of providing the cartridge, and thus, the arbitrary unlocking of the cartridge by an unauthorized user may be prevented.

BEST MODE

Figure 1:
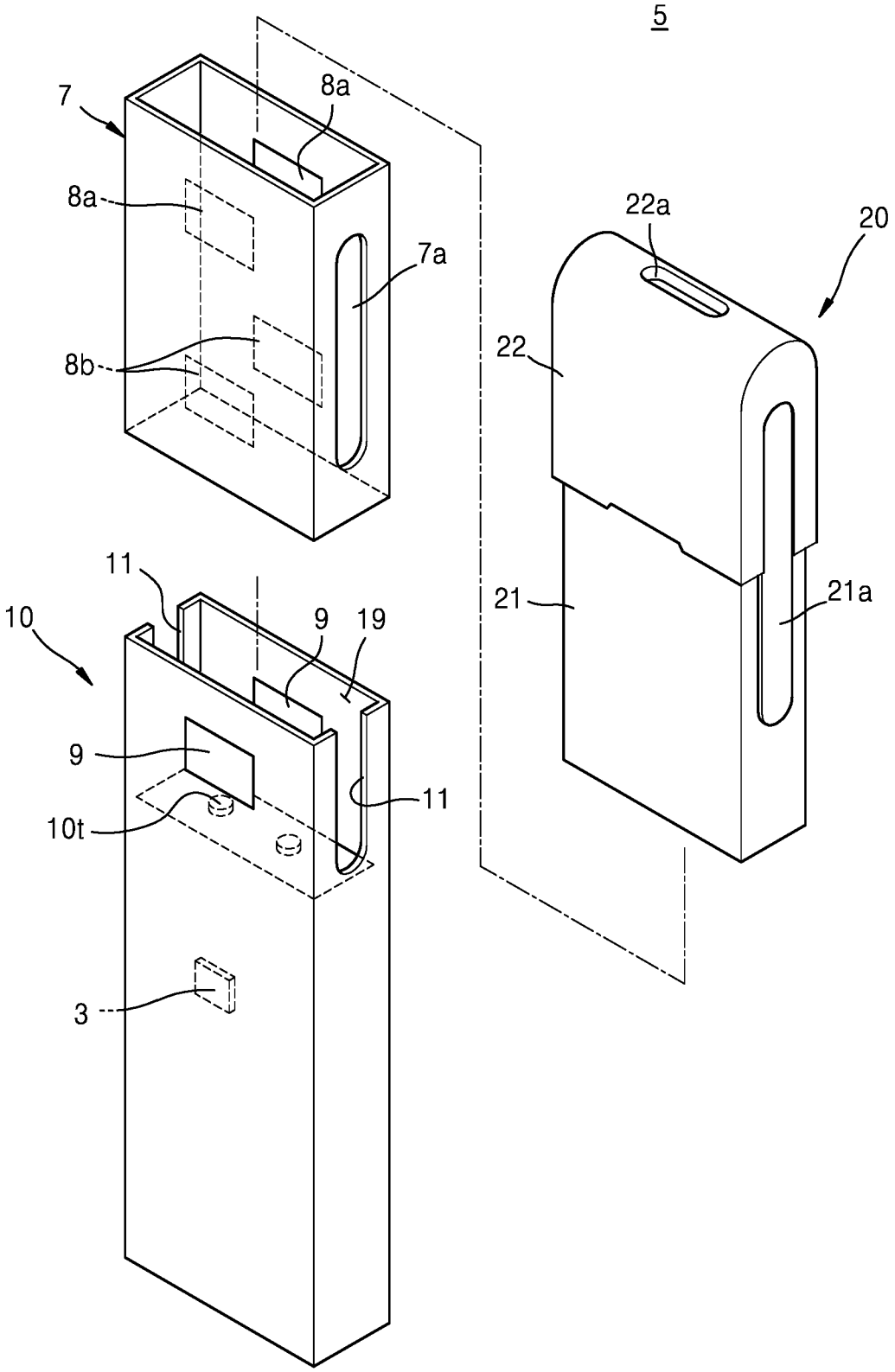
FIG. 1 is an exploded perspective view schematically illustrating a coupling relationship between a replaceable cartridge containing an aerosol generating material and an aerosol generating device including the same, according to an embodiment.

According to one or more embodiments, a cartridge includes a connector comprising a plurality of terminals configured to provide an electrical connection between the cartridge and an external device; a heater configured to be heated by a current flowing through a first pair of terminals among the plurality of terminals; and a processor configured to: count a number of times a signal is received through a second pair of terminals among the plurality of terminals, store information about the number of times corresponding to a counting result in a memory, and control the memory to initialize the stored number of time when the plurality of terminals are short-circuited according to a preset pattern.

The processor may initialize the stored number, when a first set of terminals are short-circuited and a second set of terminals are short-circuited sequentially within a preset period of time.

The first set of terminals may include a first terminal, a second terminal, and a third terminal, the second set of terminals may include the third terminal and a fourth terminal, the first terminal and the third terminal may correspond to the first pair of terminals, and the second terminal and the fourth terminal may correspond to the second pair of terminals.

The first set of terminals may include a first terminal and a second terminal, the second set of terminals may include the second terminal and a third terminal, the first terminal and the second terminal may correspond to the first pair of terminals, and the first terminal and the third terminal may correspond to the second pair of terminals.

The first pair of terminals and the second pair of terminals may share a ground terminal.

The signal may be received through the second pair of terminals whenever an operation associated with smoking by a user is detected by the aerosol generating device.

The signal may be received through the second pair of terminals whenever a puff is detected by the aerosol generating device, and the processor is configured to block the current flowing through the first pair of terminals when the counted number of times reaches a threshold value.

Each of the plurality of terminals may have a pin structure including a spring.

MODE FOR INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes the cartridge 20 containing the aerosol generating material and a main body 10 supporting the cartridge 20.

The cartridge 20 containing the aerosol generating material may be coupled to the main body 10. A portion of the cartridge 20 is inserted into an accommodation space 19 of the main body 10 so that the cartridge 20 may be mounted on the main body 10.

The cartridge 20 may contain an aerosol generating material in any one of, for example, a liquid state, a solid state, a gaseous state, or a gel state. The aerosol generating material may include a liquid composition. For example, the liquid composition may be a liquid including a tobacco-containing material, a liquid having a volatile tobacco flavor component, and/or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating an aerosol by converting the phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material by receiving the electrical signal from the main body 10 and heating the aerosol generating material, or by using an ultrasonic vibration method, or by using an induction heating method. As another example, when the cartridge 20 includes its own power source, the cartridge 20 may generate aerosol by being operated by an electric control signal or a wireless signal transmitted from the main body 10 to the cartridge 20.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element including (e.g., impregnated with) an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to the aerosol, and a heater heating the liquid delivery element to generate the aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which performs both the functions of absorbing the aerosol generating material and maintaining the same in an optimal state for conversion to aerosol without using a separate liquid delivery element and the function of generating aerosol by heating the aerosol generating material.

At least a portion of the liquid storage 21 of the cartridge 20 may include a transparent material so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and the liquid storage 21 may be entirely formed of transparent plastic or glass. Alternatively, only the protruding window 21*a* corresponding to a portion of the liquid storage 21 may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to operation of the cartridge 20 to the cartridge 20.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 to move with respect to the main body 10. The slider 7 covers at least a portion of the mouthpiece 22 of the cartridge 20 coupled to the main body 10 or exposes at least a portion of the mouthpiece 22 to the outside by moving with respect to the main body 10. The slider 7 includes an elongated hole 7*a* exposing at least a portion of the protruding window 21*a* of the cartridge 20 to the outside.

The slider 7 has a container shape with a hollow space therein and both ends opened. The structure of the slider 7 is not limited to the container shape as shown in the drawing, and the slider 7 may have a bent plate structure having a clip-shaped cross-section, which is movable with respect to the main body 10 while being coupled to an edge of the main body 10, or a structure having a curved semi-cylindrical shape and a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body includes two first magnetic bodies 8*a* facing each other with an inner space of the slider 7 in between, and two second magnetic bodies 8*b* facing each other with the inner space of the slider 7 in between. The first magnetic bodies 8*a* and the second magnetic bodies 8*b* are arranged to be spaced apart from each other along a longitudinal direction of the main body 10, which is a moving direction of the slider 7, that is, the direction in which the main body 10 extends.

The main body 10 includes a fixed magnetic body 9 arranged on a path along which the first magnetic bodies 8*a* and the second magnetic bodies 8*b* of the slider 7 move while the slider 7 moves with respect to the main body 10. Two fixed magnetic bodies 9 of the main body 10 may be mounted to face each other with the accommodation space 19 in between.

Depending on the position of the slider 7, the slider 7 may be stably maintained in a position where an end of the mouthpiece 22 is covered or exposed by a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move while the slider 7 moves with respect to the main body 10. The position change detecting sensor 3 may include, for example, a Hall integrated circuit (IC) that detects a change in a magnetic field according to the Hall effect and generates a signal.

In the aerosol generating device 5 according to the above-described embodiments, the main body 10, the cartridge 20, and the slider 7 have approximately rectangular cross-sectional shapes in a direction transverse to the longitudinal direction, but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly when extending in the longitudinal direction, and may extend a long way while being curved in a streamlined shape or bent at a preset angle in a specific area to be easily held by the user.

Figure 2:
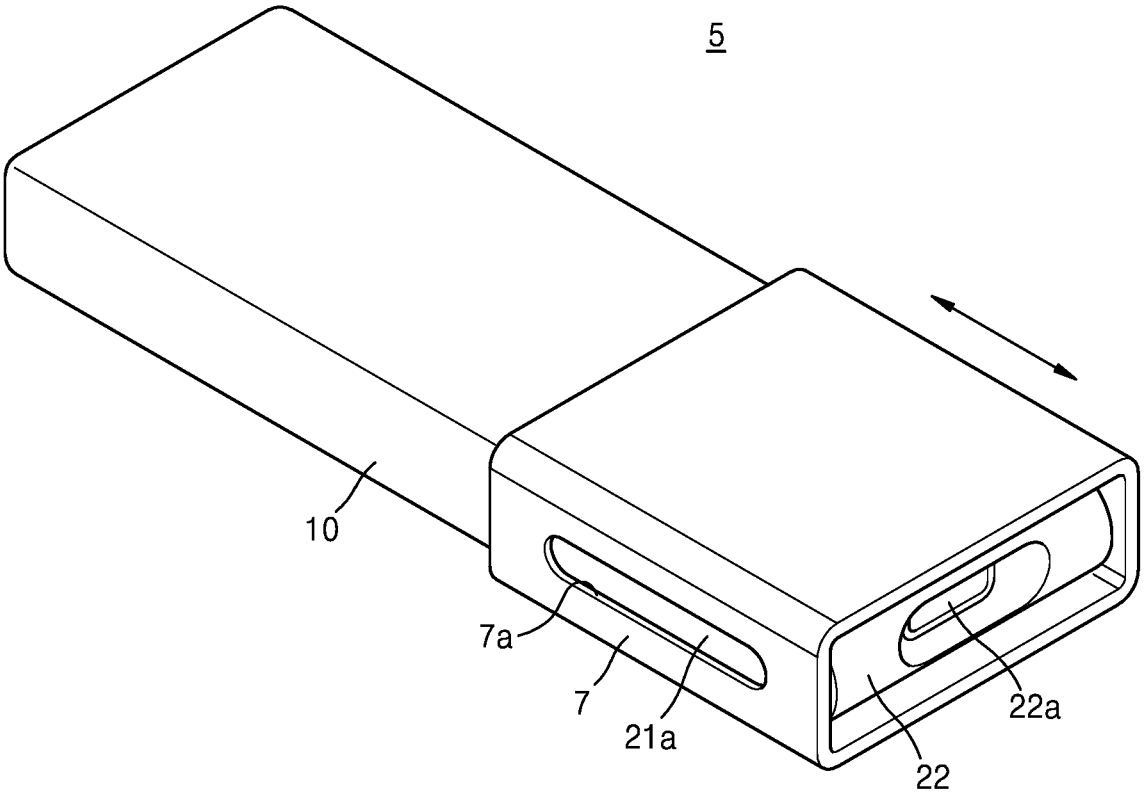
FIG. 2 is a perspective view of an exemplary operating state of the aerosol generating device according to the embodiment illustrated in FIG. 1.

FIG. 2 is a perspective view of an exemplary operating state of the aerosol generating device according to the embodiment illustrated in FIG. 1.

In FIG. 2, the operating state is shown in which the slider 7 is moved to a position where the end of the mouthpiece 22 of the cartridge coupled to the main body 10 is covered. In a state where the slider 7 is moved to the position where the end of the mouthpiece 22 is covered, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

Figure 3:
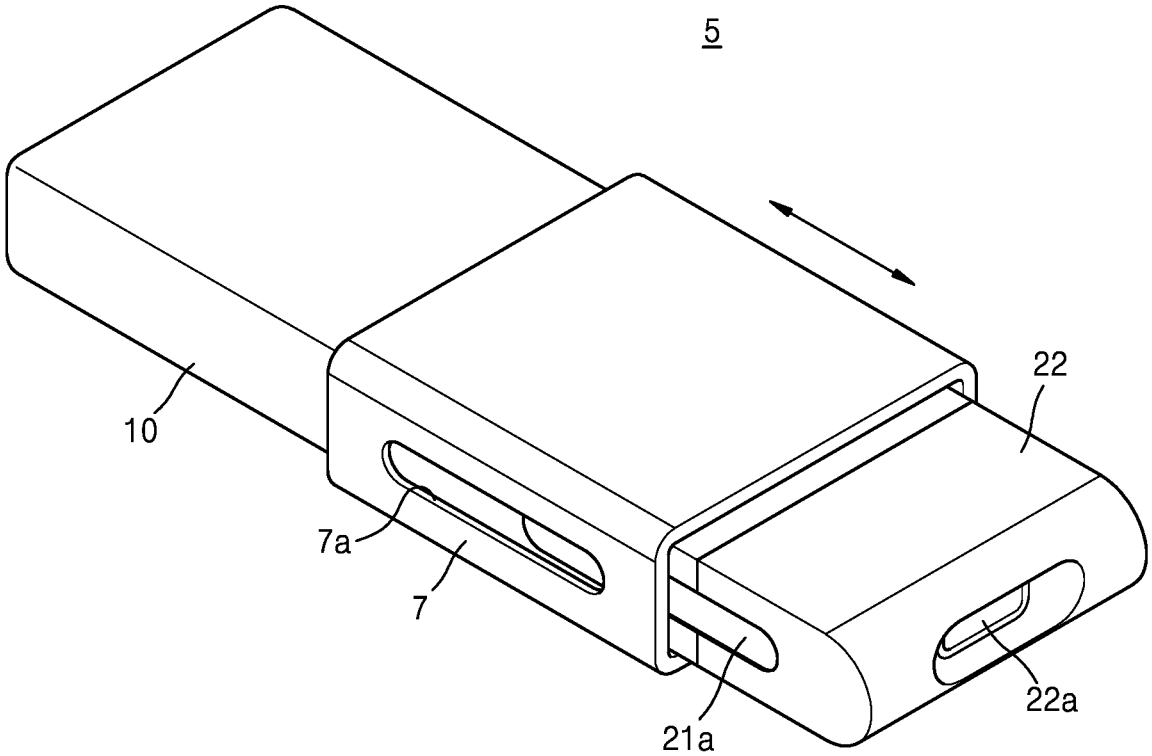
FIG. 3 is a perspective view of another exemplary operating state of the aerosol generating device according to the embodiment illustrated in FIG. 1.

FIG. 3 is a perspective view of another exemplary operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In a state where the slider 7 is moved to the position where the end of the mouthpiece 22 is exposed to the outside, the user may insert the mouthpiece 22 into his or her mouth and absorb aerosol discharged through the discharge hole 22*a* of the mouthpiece 22.

Even when the slider 7 is moved to the position where the end of the mouthpiece 22 is exposed to the outside, the protruding window 21*a* of the cartridge is exposed to the outside through the elongated hole 7*a* of the slider 7, and thus, the user may visually check the remaining amount of aerosol generating material contained in the cartridge.

Figure 4:
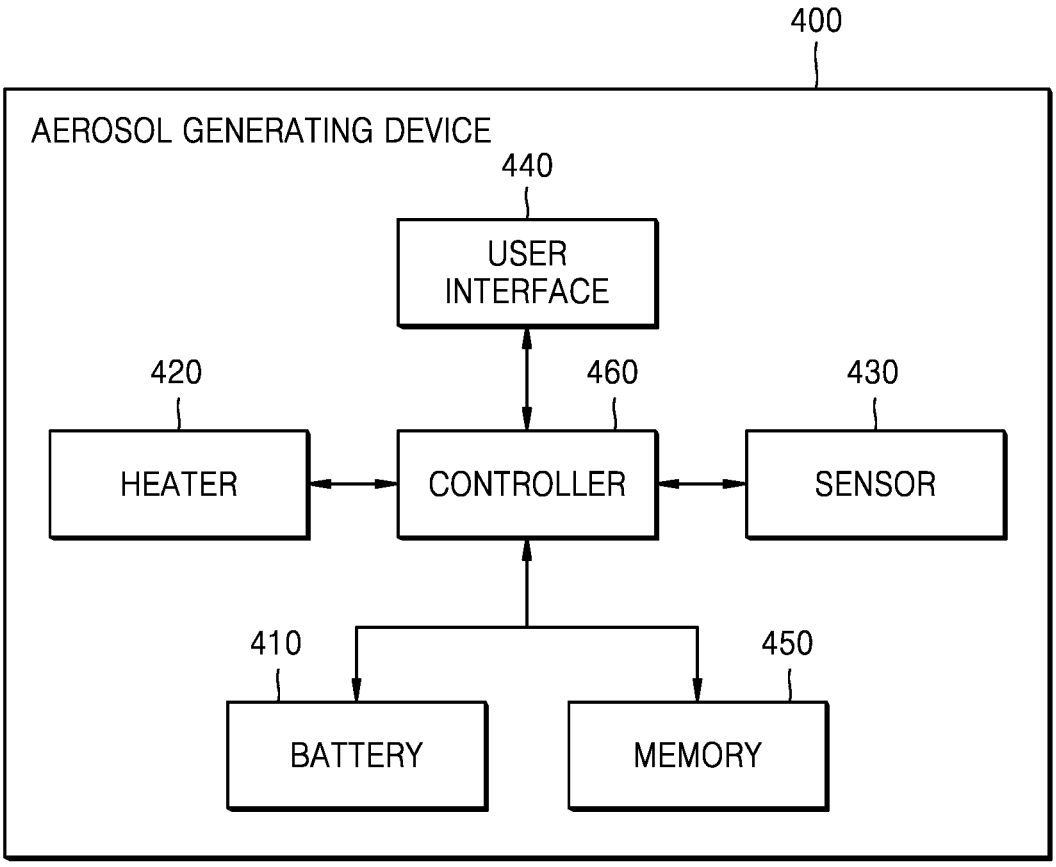
FIG. 4 is a block diagram illustrating hardware components of the aerosol generating device according to an embodiment.

FIG. 4 is a block diagram illustrating hardware components of the aerosol generating device according to an embodiment.

Referring to FIG. 4, the aerosol generating device 400 may include a battery 410, a heater 420, a sensor 430, a user interface 440, a memory 450, and a controller 460. However, the internal structure of the aerosol generating device 400 is not limited to the structures illustrated in FIG. 4. According to the design of the aerosol generating device 400, it will be understood by one of ordinary skill in the art that some of the components shown in FIG. 4 may be omitted or new components may be added.

In an embodiment, the aerosol generating device 400 may consist of only a main body, in which case components included in the aerosol generating device 400 are located in the main body. In another embodiment, the aerosol generating device 400 may consist of a main body and a cartridge, in which case components included in the aerosol generating device 400 are located separately in the main body and the cartridge. Alternatively, at least some of components included in the aerosol generating device 400 may be located respectively in the main body and the cartridge.

Hereinafter, operation of each of the components will be described without being limited to their locations in the aerosol generating device 400.

The battery 410 supplies power to be used for the aerosol generating device 400 to operate. In other words, the battery 410 may supply power such that the heater 420 may be heated. In addition, the battery 410 may supply power required for operation of other components included in the aerosol generating device 400, that is, the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 460. The heater 420 may receive power from the battery 410 and heat an aerosol generating article inserted into the aerosol generating device 400, or heat the cartridge mounted on the aerosol generating device 400.

The heater 420 may be located in the main body of the aerosol generating device 400. Alternatively, when the aerosol generating device 400 consists of the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an embodiment, the heater 420 may be a component included in the cartridge. The cartridge may include the heater 420, the liquid delivery element, and the liquid storage. The aerosol generating material accommodated in the liquid storage may be moved to the liquid delivery element, and the heater 420 may heat the aerosol generating material absorbed by the liquid delivery element, thereby generating aerosol. For example, the heater 420 may include a material such as nickel chromium and may be wound around or arranged adjacent to the liquid delivery element.

The heater 420 may be an induction heating-type heater. The heater 420 may include an electrically conductive coil for heating an aerosol generating article by an induction heating method, and the aerosol generating article or the cartridge may include a susceptor which may be heated by the induction heater.

The aerosol generating device 400 may include at least one sensor 430. A result sensed by the at least one sensor 430 is transmitted to the controller 460, and the controller 460 may control the aerosol generating device 400 to perform various functions such as controlling the operation of the heater 420, restricting smoking, determining whether an aerosol generating article (or a cartridge) is inserted, and displaying a notification.

For example, the at least one sensor 430 may include a puff sensor. The puff detecting sensor may detect a user's puff based on any one of a temperature change, a flow change, a voltage change, and a pressure change.

In addition, the at least one sensor 430 may include a temperature sensor. The temperature sensor may detect the temperature at which the heater 420 (or an aerosol generating material) is heated. The aerosol generating device 400 may include a separate temperature sensor for sensing a temperature of the heater 420, or the heater 420 itself may serve as a temperature sensor instead of including a separate temperature sensor. Alternatively, a separate temperature sensor may be further included in the aerosol generating device 400 while the heater 420 serves as a temperature sensor.

In addition, the at least one sensor 430 may include a position sensor. The position sensor may detect a change in a position of the slider coupled to the main body to move with respect to the main body.

The user interface 440 may provide the user with information about the state of the aerosol generating device 400. The user interface 440 may include various interfacing devices, such as a display or a light emitter for outputting visual information, a motor for outputting haptic information, a speaker for outputting sound information, input/output (I/O) interfacing devices (e.g., a button or a touch screen) for receiving information input from the user or outputting information to the user, terminals for performing data communication or receiving charging power, and communication interfacing modules for performing wireless communication (e.g., Wi-Fi, Wi-Fi direct, Bluetooth, near-field communication (NFC), etc.) with external devices.

However, the aerosol generating device 400 may be implemented by selecting only some of the above-described examples of various user interface 440.

The memory 450, as a hardware component configured to store various pieces of data processed in the aerosol generating device 400, may store data processed or to be processed by the controller 460. The memory 450 may include various types of memories; random access memory (RAM), such as dynamic random access memory (DRAM) and static random access memory (SRAM), etc.; read-only memory (ROM); electrically erasable programmable read-only memory (EEPROM), etc.

The memory 450 may store an operation time of the aerosol generating device 400, the maximum number of puffs, the current number of puffs, at least one temperature profile, data on a user's smoking pattern, etc.

The controller 460 may generally control operations of the aerosol generating device 400. The controller 460 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 460 analyzes a result of the sensing by at least one sensor 430, and controls the processes that are to be performed subsequently.

The controller 460 may control power supplied to the heater 420 so that the operation of the heater 420 is started or terminated, based on the result of the sensing by the at least one sensor 430. In addition, based on the result of the sensing by the at least one sensor 430, the controller 460 may control the amount of power supplied to the heater 420 and the time at which the power is supplied, so that the heater 420 is heated to a predetermined temperature or maintained at an appropriate temperature.

The controller 460 may control the user interface 440 based on the result of the sensing by the at least one sensor 430. For example, when the number of puffs reaches the preset number after counting the number of puffs by using the puff sensor, the controller 460 may notify the user by using at least one of a light emitter, a motor, or a speaker that the aerosol generating device 400 will soon be terminated.

Although not illustrated in FIG. 4, the aerosol generating device 400 may form an aerosol generating system together with an additional cradle. For example, the cradle may be used to charge the battery 410 of the aerosol generating device 400. For example, while the aerosol generating device 400 is accommodated in an accommodation space of the cradle, the aerosol generating device 400 may receive power from a battery of the cradle such that the battery 410 of the aerosol generating device 400 may be charged.

Figure 5:
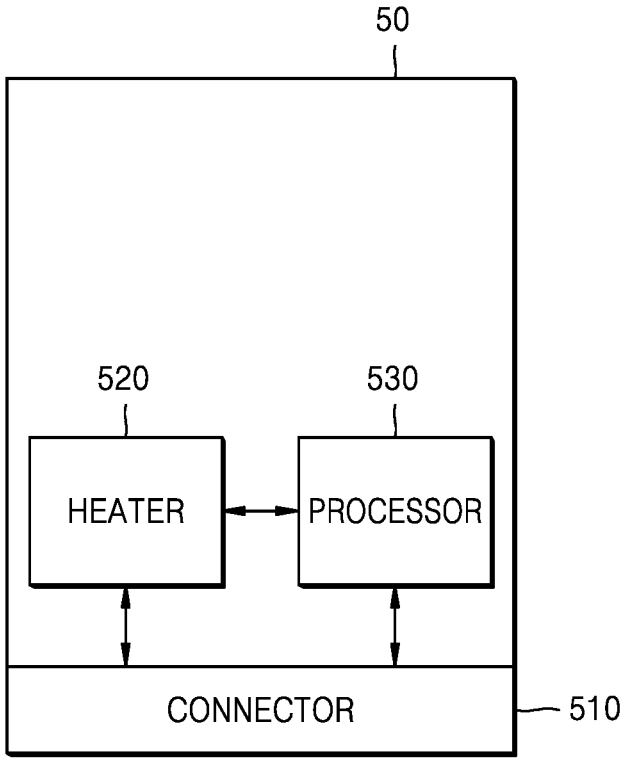
FIG. 5 is a block diagram illustrating a configuration of a cartridge according to an embodiment.

FIG. 5 is a block diagram illustrating a configuration of a cartridge according to an embodiment.

Referring to FIG. 5, a cartridge 50 may include a connector 510, a heater 520, and a processor 530. The cartridge 50 of FIG. 5 may correspond to the cartridge 20 of FIG. 1, and the heater 520 of FIG. 5 may correspond to the heater 420 of FIG. 4. Thus, repeated descriptions thereof will be omitted. The processor 530 of FIG. 5 may be distinct from the controller 460 that controls overall operation of the aerosol generating device 40 of FIG. 4, and may be disposed inside the cartridge 50.

Referring to FIG. 5, some components of the cartridge 50, which are particularly relevant to the present embodiment. Therefore, it would be understood by one of ordinary skill in the art that other components may be further included in the cartridge 50 in addition to the components shown in FIG. 5.

The connector 510 may include various terminals for forming an electrical connection between the cartridge 50 and an external device. The external device may by any devices that may be electrically connected to the cartridge 50. For example, the external device may be an aerosol generating device or a separate computing device for performing a software task in connection with the processor 530 in the cartridge 50.

Each of the terminals included in the connector 510 may have a pin structure including a spring. For example, each terminal may correspond to a pogo pin, but is not limited thereto. Any other structure may be applicable without limitation as long as the structure has great durability and is appropriate to form an electrical connection with the external device.

The heater 520 may be heated by a current flowing through a first pair of terminals among the terminals included in the connector 510. Each of the first pair of terminals may correspond to either a positive (+) terminal or a negative (−) terminal. However, one or more embodiments are not limited thereto. One of the first pair of terminals may be a ground terminal, and the other thereof may be a positive terminal or a negative terminal. For example, when the cartridge 50 is coupled to the aerosol generating device, the heater 520 may be heated by the current transmitted from the aerosol generating device through the first pair of terminals.

The processor 530 may count the number of times a signal is received through a second pair of terminals, and may store the number of times corresponding to a counting result. Each of the second pair of terminals may correspond to a positive terminal or a negative terminal. However, one or more embodiments are not limited thereto. For example, one of the second pair of the terminals may correspond to a ground terminal, and the other thereof may correspond to a positive terminal or a negative terminal. When the cartridge 50 is coupled to the aerosol generating device, the processor 530 may receive a signal transmitted from the aerosol generating device through the second pair of terminals.

The processor 530 may be embodied by using at least one logic gate to perform counting and may include a memory to store the number of times corresponding to the counting result. The memory of the processor 530 may be a non-volatile memory to memorize the stored number of times even when power is not supplied. Although not illustrated in FIG. 5, the cartridge 50 may include a memory disposed outside the processor 530, and the counted number may be stored therein.

When the cartridge 50 is electrically connected to the aerosol generating device through the connector 510, and a signal may be received through the second pair of terminals the aerosol generating device whenever a user's act associated with smoking is detected by the aerosol generating device. For example, the act associated with the smoking by the user may correspond to a puff of the user. The aerosol generating device may detect the puff of the user and transmit the signal to the cartridge 50 through the second pair of terminals. Therefore, the number stored in the processor 530 may correspond to the number of puffs performed by the user with the cartridge 50, but embodiments are not limited thereto.

The processor 530 may block the current flowing through the first pair of terminals when the stored number of puffs reaches a threshold value. The threshold value may be proportional to the total amount of liquid composition that is initially accommodated in the cartridge 50. Based on the amount of liquid composition consumed by a single puff of a normal user, the number of puffs corresponding to the total amount of liquid composition initially accommodated in the cartridge 50 may be calculated, and the threshold value may be determined by adding a certain margin to the calculated number of puffs.

Heating of the heater 520 may be stopped as the current flowing through the first pair of terminals is blocked, and thereby user's smoking with the cartridge 50 may be prevented. The current flowing through the first pair of terminals may be blocked under the control of the processor 530, but one or more embodiments are not limited thereto. For example, the current flowing through the first pair of terminals may be blocked by using a separate mechanical or physical device inside the cartridge 50. As another example, the current flowing through the first pair of terminals may be blocked by the aerosol generating device coupled to the cartridge 50, not by the cartridge 50.

As described above, when it is determined that the liquid composition initially accommodated in the cartridge 50 is consumed, the cartridge 50 may be locked to prevent the use of the cartridge 50. Accordingly, the unauthorized reuse of the cartridge 50 may be prevented.

The processor 530 may initialize the number of puffs stored in the processor 530 when the terminals are short-circuited according to a preset pattern. For example, when a second set of terminals are short-circuited within a preset period of time after a first set of terminals are short-circuited, the processor 530 may initialize the number of puffs. Hereinafter, embodiments in which the number of puffs stored in the processor 530 is initialized as the terminals are short-circuited according to the preset pattern will be described in detail with reference to FIGS. 6 and 7.

Figure 6:
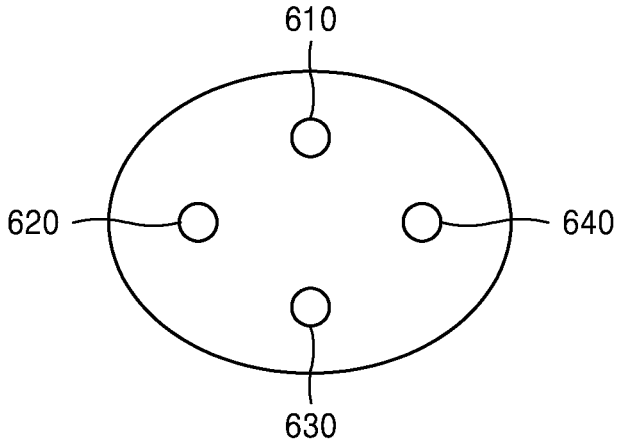
FIG. 6 is a diagram illustrating one end of a cartridge according to an embodiment.

FIG. 6 is a diagram illustrating one end of a cartridge according to an embodiment.

FIG. 6 illustrates one end of the cartridge. The illustrated end may be coupled to the aerosol generating device and may be an end at which a connector is disposed. FIG. 6 illustrates that the connector of the cartridge includes four terminals, that is, a first terminal 610, a second terminal 620, a third terminal 630, and a fourth terminal 640.

The first terminal 610 and the third terminal 630 may correspond to the first pair of terminals through which the current may flow to the heater to supply power, and the second terminal 620 and the fourth terminal 640 may correspond to the second pair of terminals through which the signal from the aerosol generating device is received.

If the first terminal 610, the second terminal 620, and the third terminal 630 ("first set of terminals") are short-circuited first, and then the third terminal 630 and the fourth terminal 640 ("second set of terminals") are short-circuited within the preset period of time, a processor of the cartridge may initialize the number (i.e., the number of puffs of the user). As the number of puffs stored in the processor is initialized to 0, the number may become less than the threshold value, and the cartridge may be unlocked accordingly. The short-circuiting of at least some of the terminals may be manually performed by an authorized provider. However, one or more embodiments are not limited thereto. The short-circuiting of at least some of the terminals may be performed by a separate computing device for performing a software task in connection with the processor of the cartridge.

FIG. 6 illustrates that the connector of the cartridge includes four terminals in total, but the number of terminals included in the connector of the cartridge may be less than or greater than four. It may be understood by one of ordinary skill in the art that, although the number of terminals included in the connector of the cartridge is changed, the initialization of the cartridge may be performed as the terminals are short-circuited according to the preset pattern (e.g., by short-circuiting a first set of terminals first and then short-circuiting a second set of terminals within a preset time period). Hereinafter, an embodiment in which a connector of a cartridge includes three terminals will be described with reference to FIG. 7.

Figure 7:
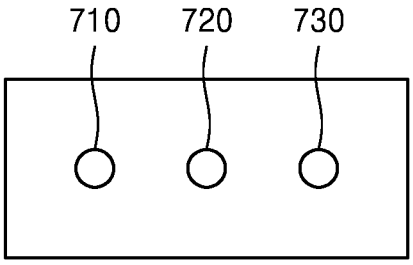
FIG. 7 is a diagram illustrating one end of a cartridge according to another embodiment.

FIG. 7 is a diagram illustrating one end of a cartridge according to another embodiment.

FIG. 7 illustrates one end of the cartridge. The illustrated end may be coupled to the aerosol generating device and may correspond to an end at which the connector is disposed. FIG. 7 illustrates that the connector of the cartridge includes three terminals, that is, a first terminal 710, a second terminal 720, and a third terminal 730.

The first terminal 710 and the second terminal 720 may correspond to a first pair of terminals through which a current flows to a heater to supply power, and the first terminal 710 and the third terminal 730 may correspond to a second pair of terminals through which a signal from the aerosol generating device is received. The first pair of terminals and the second pair of terminals may commonly include the first terminal 710 as a ground terminal.

If the first terminal 710 and the second terminal 720 (i.e., the first set of terminals) are short-circuited first, and then the second terminal 720 and the third terminal 730 (i.e., the second set of terminals) are short-circuited within a preset period of time, a processor of the cartridge may initialize the stored number (e.g., the number of puffs of the user). As the number of puffs stored in the processor is initialized to 0, the number of puffs may become less than the threshold value, and the cartridge may be no longer locked accordingly.

FIGS. 6 and 7 illustrate an example in which the terminals are short-circuited according to the preset pattern to initialize the number of puffs stored in the processor and only illustrate that two sets of terminals are sequentially short-circuited within the preset period of time. However, two or more sets of terminals may be continuously short-circuited within the preset period of time.

The processor of the cartridge according to the present embodiment may initialize the stored number of puffs when the terminals of the connector are short-circuited according to the preset pattern. As described above, because the cartridge may be unlocked by using a simple method of short-circuiting the terminals of the connector according to the preset pattern, productivity may be improved in a process of recycling the cartridge by the authorized provider. Also, the pattern used to short-circuit the terminals to unlock the cartridge is determined by a provider, and thus, the unauthorized user may not be allowed to arbitrarily unlock the cartridge.

At least one of the components, elements, modules or units (collectively "components" in this paragraph) represented by a block in the drawings, such as the controller 460, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

One embodiment may also be implemented in the form of a computer-readable recording medium including instructions executable by a computer, such as a program module executable by the computer. The computer-readable recording medium may be any available medium that can be accessed by a computer and includes both volatile and nonvolatile media, and removable and non-removable media. In addition, the computer-readable recording medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

What is claimed is:

1. A cartridge comprising:

a connector comprising a plurality of terminals configured to provide an electrical connection between the cartridge and an external device;

a heater configured to be heated by a current flowing through a first pair of terminals among the plurality of terminals; and a processor configured to:

count a number of times a signal is received through a second pair of terminals among the plurality of terminals, store information about the number of times corresponding to a counting result in a memory, and control the memory to initialize the number of times when the plurality of terminals are short-circuited according to a preset pattern.

2. The cartridge of claim 1, wherein the processor is configured to control the memory to initialize the stored number of times, when a first set of terminals are short-circuited and a second set of terminals are short-circuited sequentially within a preset period of time.

3. The cartridge of claim 2, wherein the first set of terminals comprise a first terminal, a second terminal, and a third terminal, the second set of terminals comprise the third terminal and a fourth terminal, the first terminal and the third terminal correspond to the first pair of terminals, and the second terminal and the fourth terminal correspond to the second pair of terminals.

4. The cartridge of claim 2, wherein the first set of terminals comprise a first terminal and a second terminal, the second set of terminals comprise the second terminal and a third terminal, the first terminal and the second terminal correspond to the first pair of terminals, and the first terminal and the third terminal correspond to the second pair of terminals.

5. The cartridge of claim 1, wherein the first pair of terminals and the second pair of terminals shares a ground terminal.

6. The cartridge of claim 1, wherein the signal is received from an aerosol generating device through the second pair of terminals whenever an operation associated with smoking by a user is detected by the aerosol generating device.

7. The cartridge of claim 6, wherein the signal is received through the second pair of terminals whenever a puff is detected by the aerosol generating device, and the processor is configured to block the current flowing through the first pair of terminals when the counted number of times reaches a threshold value.

8. The cartridge of claim 1, wherein each of the plurality of terminals has a pin structure including a spring.

* * * * *